US007410215B2

(12) United States Patent
Dehli

(10) Patent No.: US 7,410,215 B2
(45) Date of Patent: Aug. 12, 2008

(54) ARTICULATING CHAIR

(75) Inventor: Hans Dehli, Dana Point, CA (US)

(73) Assignee: Human Touch, LLC., Long Beach, CA (US)

( * ) Notice: Subject to any disclaimer, the term of this patent is extended or adjusted under 35 U.S.C. 154(b) by 256 days.

(21) Appl. No.: 11/078,574

(22) Filed: Mar. 11, 2005

(65) Prior Publication Data

US 2005/0200181 A1 Sep. 15, 2005

Related U.S. Application Data

(60) Provisional application No. 60/553,092, filed on Mar. 13, 2004.

(51) Int. Cl.
*A47C 1/038* (2006.01)

(52) U.S. Cl. ..... 297/300.3; 297/300.2; 297/316; 297/320; 297/340; 297/217.3; 601/99

(58) Field of Classification Search ..... 297/300.3, 297/300.2, 316, 320, 340, 217.3; 601/99
See application file for complete search history.

(56) References Cited

U.S. PATENT DOCUMENTS

| | | | | |
|---|---|---|---|---|
| 2,937,641 | A * | 5/1960 | Oetinger | 601/59 |
| 3,989,297 | A * | 11/1976 | Kerstholt | 297/300.3 |
| 4,682,815 | A * | 7/1987 | Steifensand | 297/300.3 |
| 4,709,962 | A * | 12/1987 | Steinmann | 297/300.3 |
| 5,233,973 | A * | 8/1993 | Gill et al. | 601/103 |
| 6,065,806 | A * | 5/2000 | Miyaguchi et al. | 297/362.13 |
| 6,523,896 | B1 * | 2/2003 | Uhlenbrock | 297/300.4 |
| 6,609,755 | B2 * | 8/2003 | Koepke et al. | 297/300.2 |

OTHER PUBLICATIONS

International Search Report dated Aug. 30, 2007, for PCT/US05/08084, in the name of Interactive Health, LLC.

* cited by examiner

*Primary Examiner*—Laurie K Cranmer
(74) *Attorney, Agent, or Firm*—Christie, Parker & Hale, LLP.

(57) ABSTRACT

An articulating massaging chair is provided that includes a support frame; a seat pivotally connected to the support frame by a seat pivot; and a backrest pivotally connected to the support frame by a backrest pivot.

29 Claims, 11 Drawing Sheets

ARTICULATING CHAIR

CROSS-REFERENCE TO RELATED APPLICATION

This application claims the benefit of U.S. Provisional Application No. 60/553,092, filed Mar. 13, 2004, the disclosure of which is incorporated fully herein.

FIELD OF THE INVENTION

The present invention relates generally to an articulating chair having a seat and a backrest that are each rotatably mounted to a chair support frame, and specifically to an articulating chair having a seat and a backrest that rotate at different rates of rotation and/or over different angular ranges of rotation.

BACKGROUND OF THE INVENTION

Many "reclining" chairs have a seat and a reclining backrest that may be reclined to position a user in a more prone position for increased user comfort. Such reclining is particularly useful when the chair is a massage chair having one or more massaging devices. In such a case, when a user reclines the backrest of the chair, the user's weight distribution against the chair is altered, thus altering the massaging effect that is felt by the user. When so positioned, a larger portion of the user's weight is supported by the backrest and hence a massaging force transferred from a massaging device in the backrest to the user is increased.

However, typically the seat of such reclining chairs is generally horizontally positioned, approximately parallel to a ground surface, and is not angularly movable. Accordingly, a need exists for an improved reclining or articulating chair having a seat and a backrest that are each rotatable for increased user comfort.

In one embodiment according to the present invention, a generally horizontal seat of a chair rotates towards a more inclined position during a rotation of a backrest from a generally vertical position to a more prone position. This motion allows a user's legs to be rotated towards the backrest of the chair, causing the user's back to be less stretched out when the backrest is rotated to a more prone position, thus increasing user comfort. In addition, when such a chair is a massage chair the rotation of both the seat and the backrest allows for an altering of the weight distribution of the user against the chair and hence an altering of the massaging force transferred from the chair to the user.

SUMMARY

In one embodiment, the present invention is an articulating massaging chair that includes a support frame; a seat pivotally connected to the support frame by a seat pivot; and a backrest pivotally connected to the support frame by a backrest pivot.

In another embodiment, the present invention is an articulating massaging chair that is movable between an upright position and a reclined position and includes a support frame; a seat pivotally connected to the support frame by a seat pivot; and a backrest pivotally connected to the support frame by a backrest pivot. The articulating massaging chair also includes a mounting bracket connecting to the backrest and having a slot that receives a pin, wherein the pin pivotally connects the seat to the backrest. The articulating massaging chair also includes at least one massaging device connected to at least one of the seat and the backrest.

BRIEF DESCRIPTION OF THE DRAWINGS

Novel features and advantages of the present invention will be better understood by reference to the following detailed description when considered in conjunction with the accompanying drawings wherein.

DETAILED DESCRIPTION OF THE INVENTION

As shown in FIGS. 1-11, the present invention is directed to an articulating chair having a seat and a backrest that are each rotatably mounted to a chair support frame. In one embodiment, the seat and backrest of the articulating chair rotate and different rates of rotation and over different angular ranges of rotation at a predetermined angle ratio.

Figure 1:
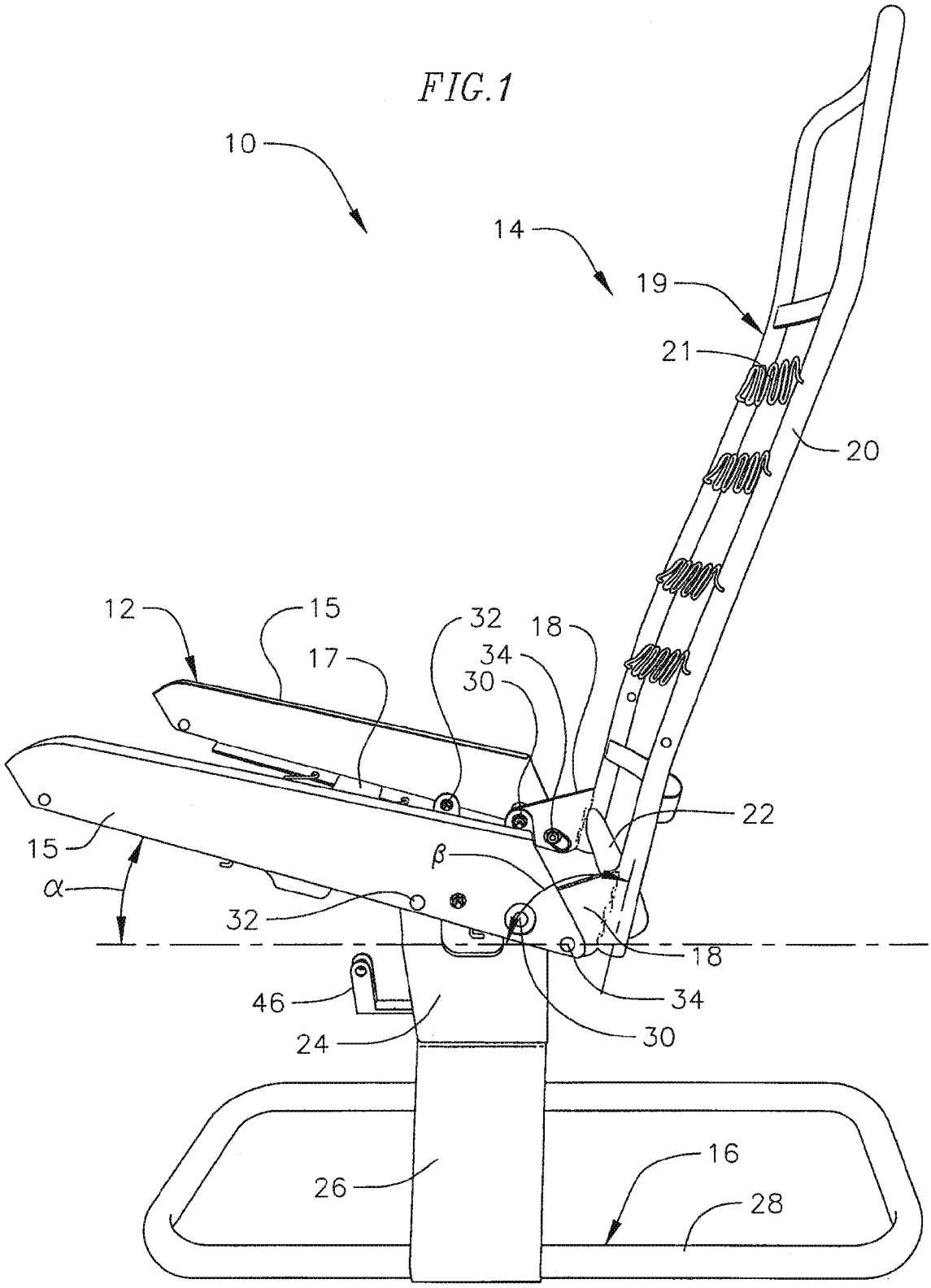
FIG. 1 is a perspective view of an articulating chair according to the present invention in an upright position, showing a seat in a generally horizontal position and a backrest in a generally vertical position.
Figure 2:
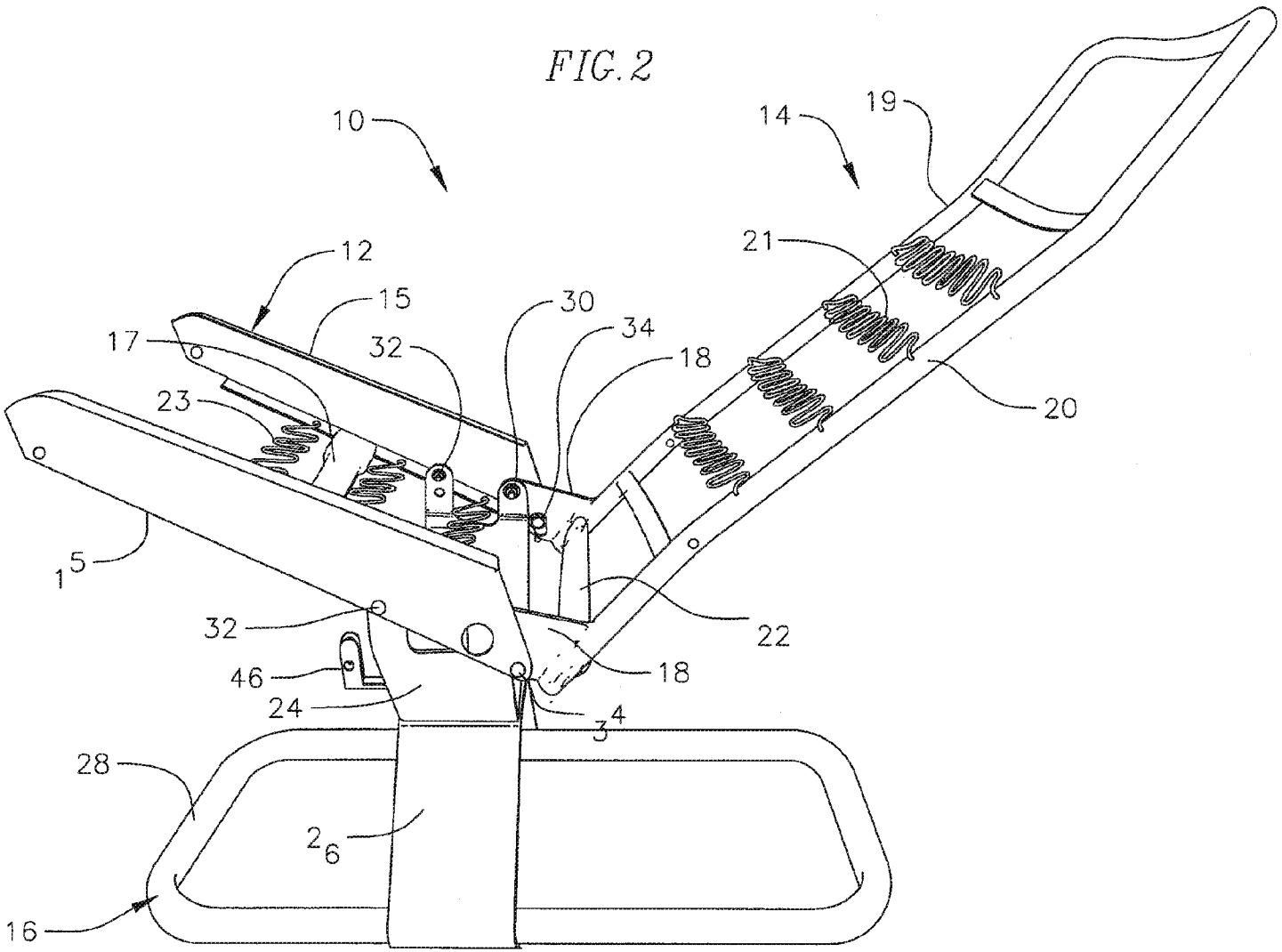
FIG. 2 is a perspective view of the articulating chair of FIG. 1 in an intermediate position, showing the seat rotated upwards from the generally horizontal position and the backrest rotated backwards from the generally vertical position.
Figure 3:
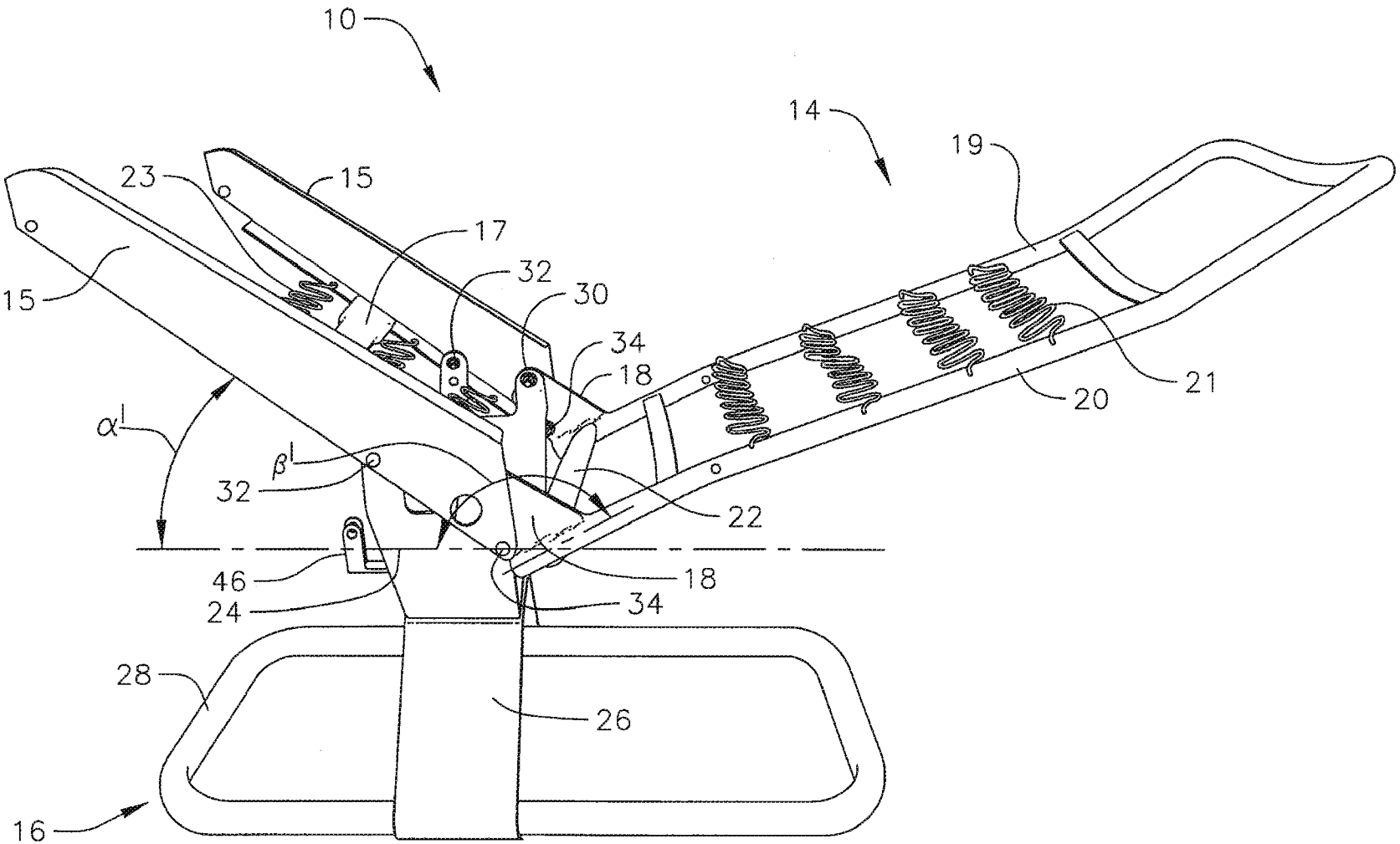
FIG. 3 is a perspective view of the articulating chair of FIG. 1 in a reclined position, showing the seat rotated further upwards from the generally horizontal position to an inclined position and the backrest rotated further backwards from the generally vertical position to a generally horizontal position.

FIGS. 1-3 show an exemplary embodiment of an articulating chair 10 according to the present invention. As shown, the articulating chair 10 includes a seat 12 and a backrest 14, which are each supported by a support frame 16.

In FIG. 1, the articulating chair 10 is in an upright position. In the upright position, the seat 12 is in a generally horizontal position and the backrest 14 is in a generally vertical position.

In FIG. 2, the articulating chair 10 is in an intermediate position. In the intermediate position, the seat 12 is rotated upwards from the generally horizontal position of FIG. 1 to a more inclined position, and the backrest 14 is rotated backwards from the generally vertical position of FIG. 1 to a more reclined position.

In FIG. 3, the articulating chair 10 is in a reclined position. In the reclined position, the seat 12 is rotated further upwards from the inclined position of FIG. 2 to a fully inclined position and the backrest 14 is rotated further backwards from the reclined position of FIG. 2 to a generally horizontal position.

Figure 4:
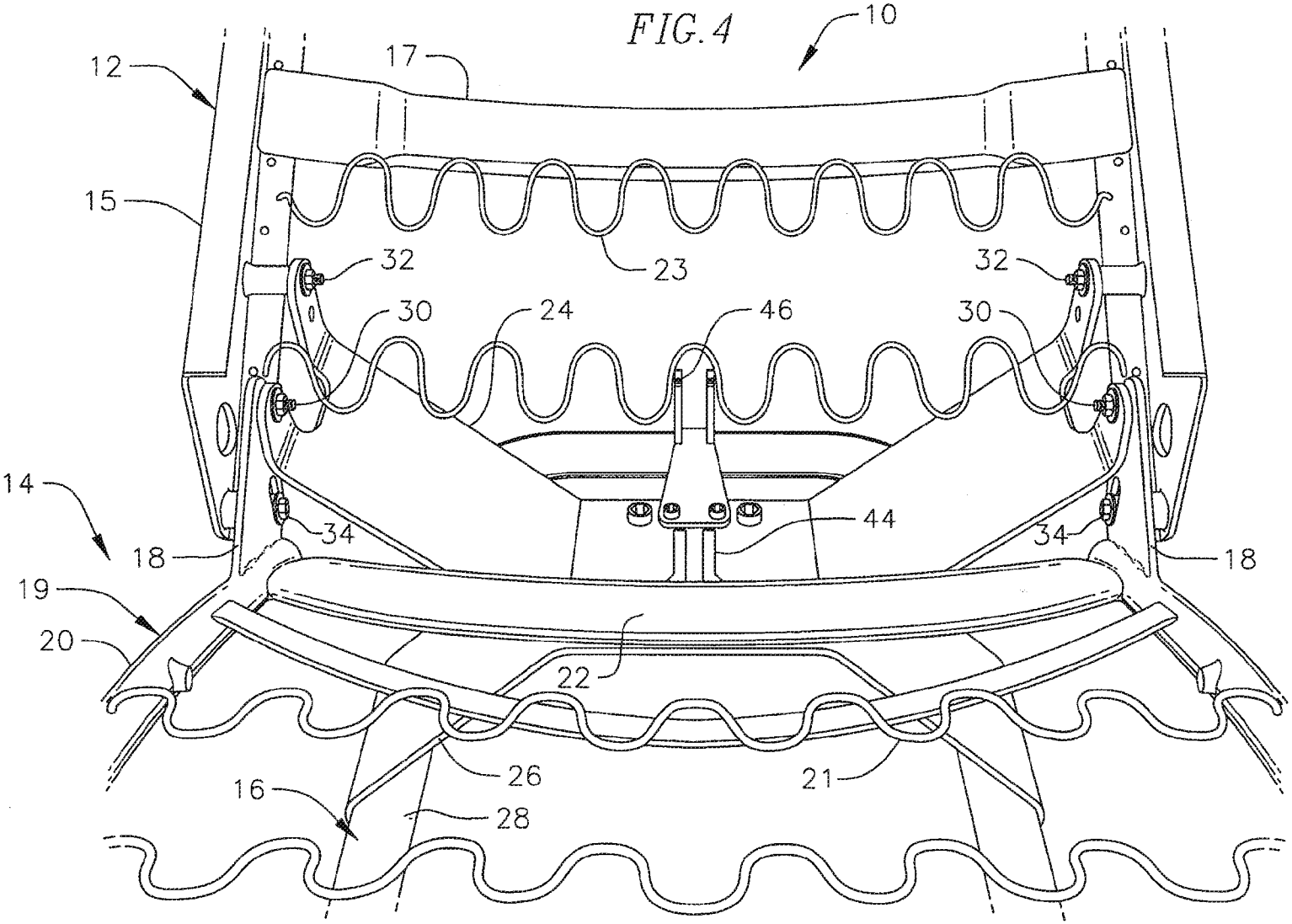
FIG. 4 is a perspective view of the articulating chair of FIG. 1, showing a bracket attached to the seat and the backrest that allows for a simultaneous rotation of the seat and the backrest.

Viewing FIGS. 1 and 4 together, the backrest 14 includes mounting brackets 18 for connection to the support frame 16. For example, in the depicted embodiment, the backrest 14 includes a rectangularly shaped support structure 19 that defines an outer periphery of the backrest 14. The support structure 19 includes a U-shaped bar 20 connected to a connecting bar 22, such as by a weld, to form the rectangular outer shape of the support structure 19. The mounting brackets 18 extend from a lower portion of the support structure 19 adjacent to the connection of the U-shaped bar 20 to the connecting bar 22. The mounting brackets 18 are mounted to the support structure 19 by a mechanical fastener, such as a weld. Mounted to the U-shaped bar 20 are a plurality of springs 21 for user comfort.

The seat 12 includes side arms 15 and a connecting bar 17 (see FIGS. 2 and 4 for clarity.) Similar to the backrest 14, a plurality of springs 23 are mounted between the side arms 15 of the seat 12 for user comfort. The support frame 16 includes an upper support 24, a lower support 26 and a base 28. The upper support 24 and the lower support 26 are each U-shaped, with the closed ends of each U-shape being mechanically fastened together, such as by nut and bolt connections, such that the open ends of each U-shape are oppositely directed, together forming a truss-like structure, or an X-shape. The lower support 26 is connected to a rectangularly shaped support frame base 28, which supports the weight of the articulating chair 10.

The mounting brackets 18 of the backrest 14 are pivotally connected to the upper support 24 by pivots 30, such as nut and bolt connections, allowing the backrest 14 to rotate relative to the support frame 16. The seat 12 is similarly pivotally connected to the upper support 24 by pivots 32, which may also be nut and bolt connections, allowing the seat 12 to rotate relative to the support frame 16.

Figure 5:
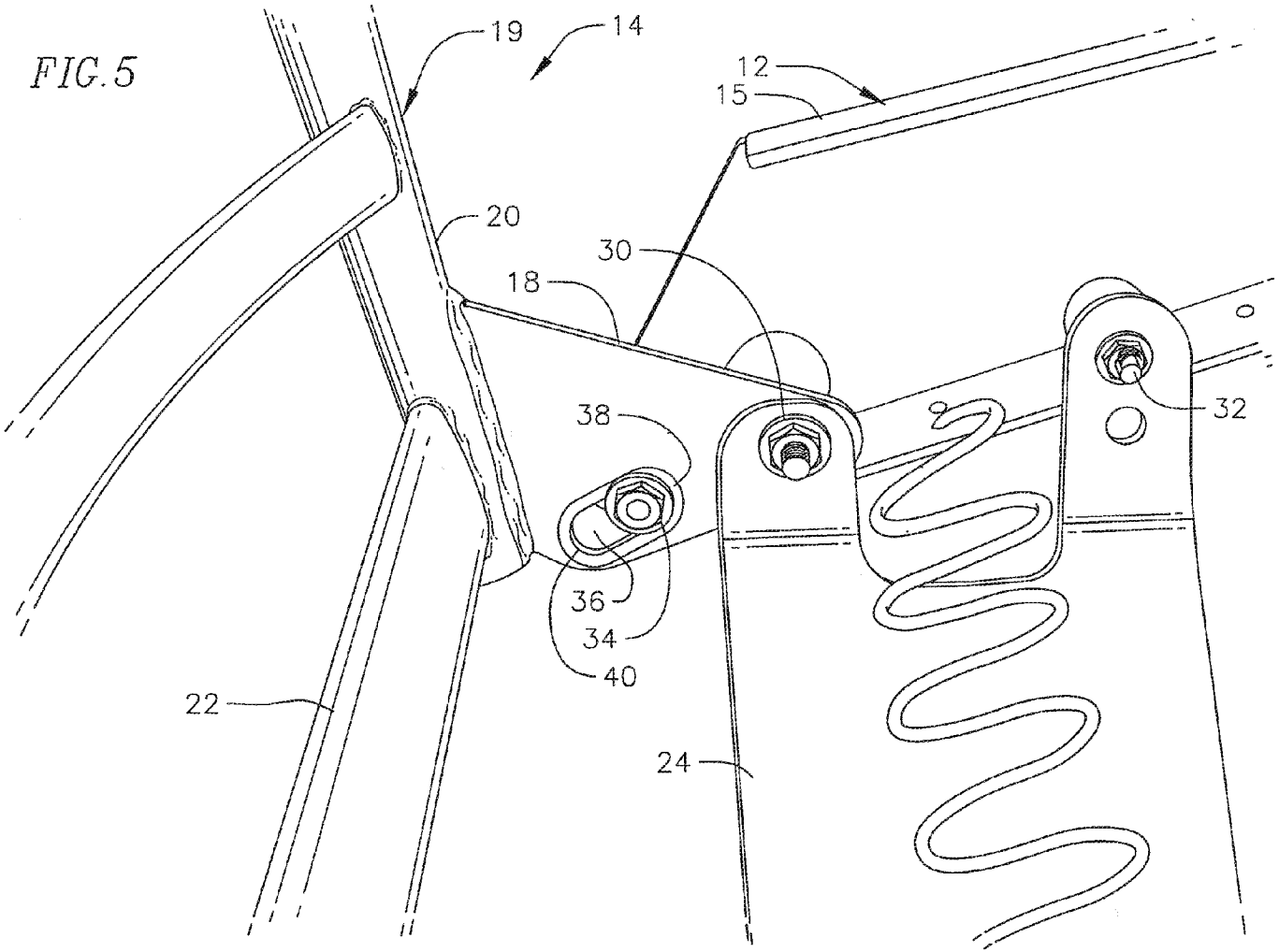
FIG. 5 is a perspective view of the bracket of FIG. 4, showing the articulating chair in the upright position of FIG. 1.
Figure 6:
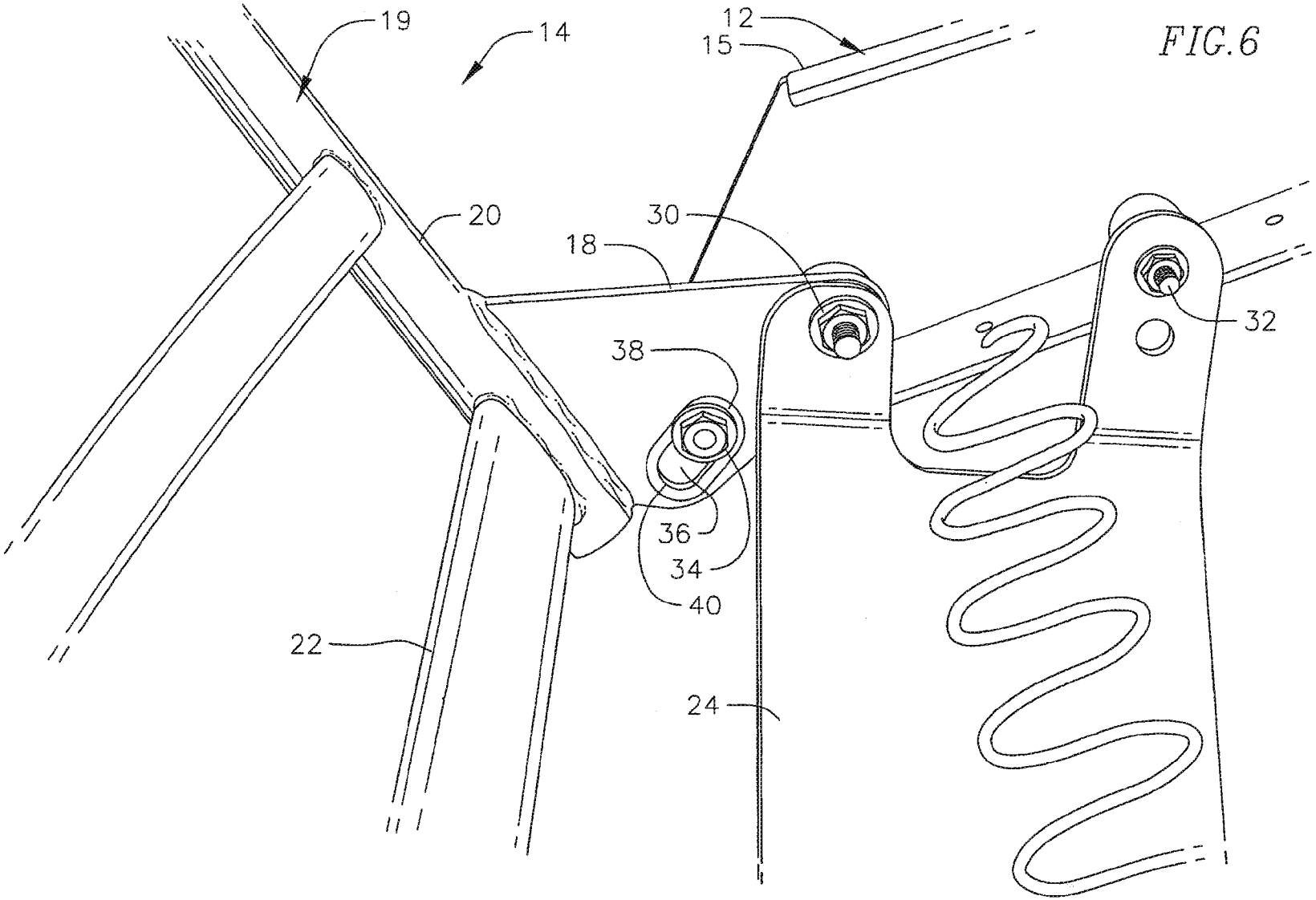
FIG. 6 is a perspective view of the bracket of FIG. 4, showing the articulating chair in the intermediate position of FIG. 2.
Figure 7:
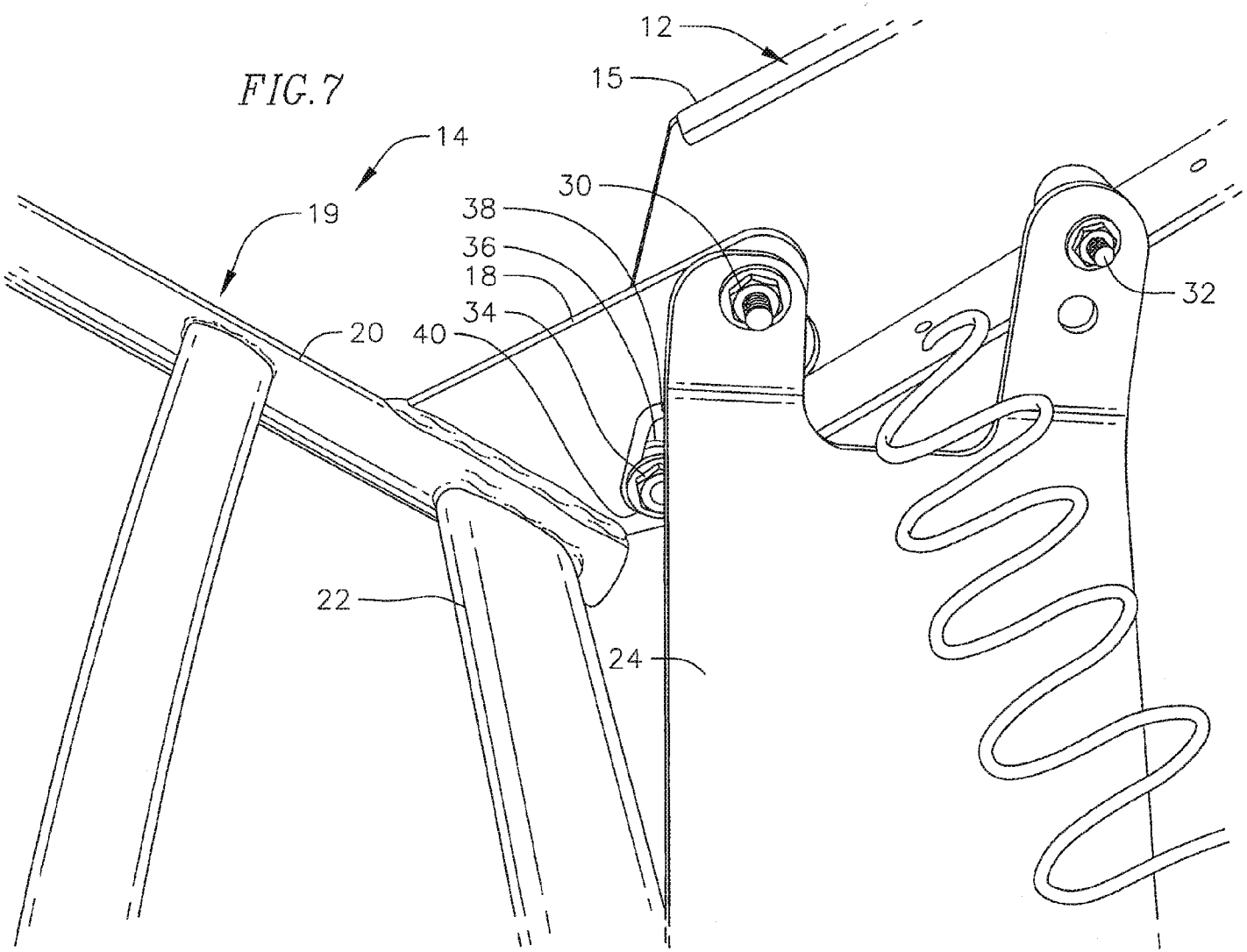
FIG. 7 is a perspective view of the bracket of FIG. 4, showing the articulating chair in the reclined position of FIG. 3.
Figure 8:
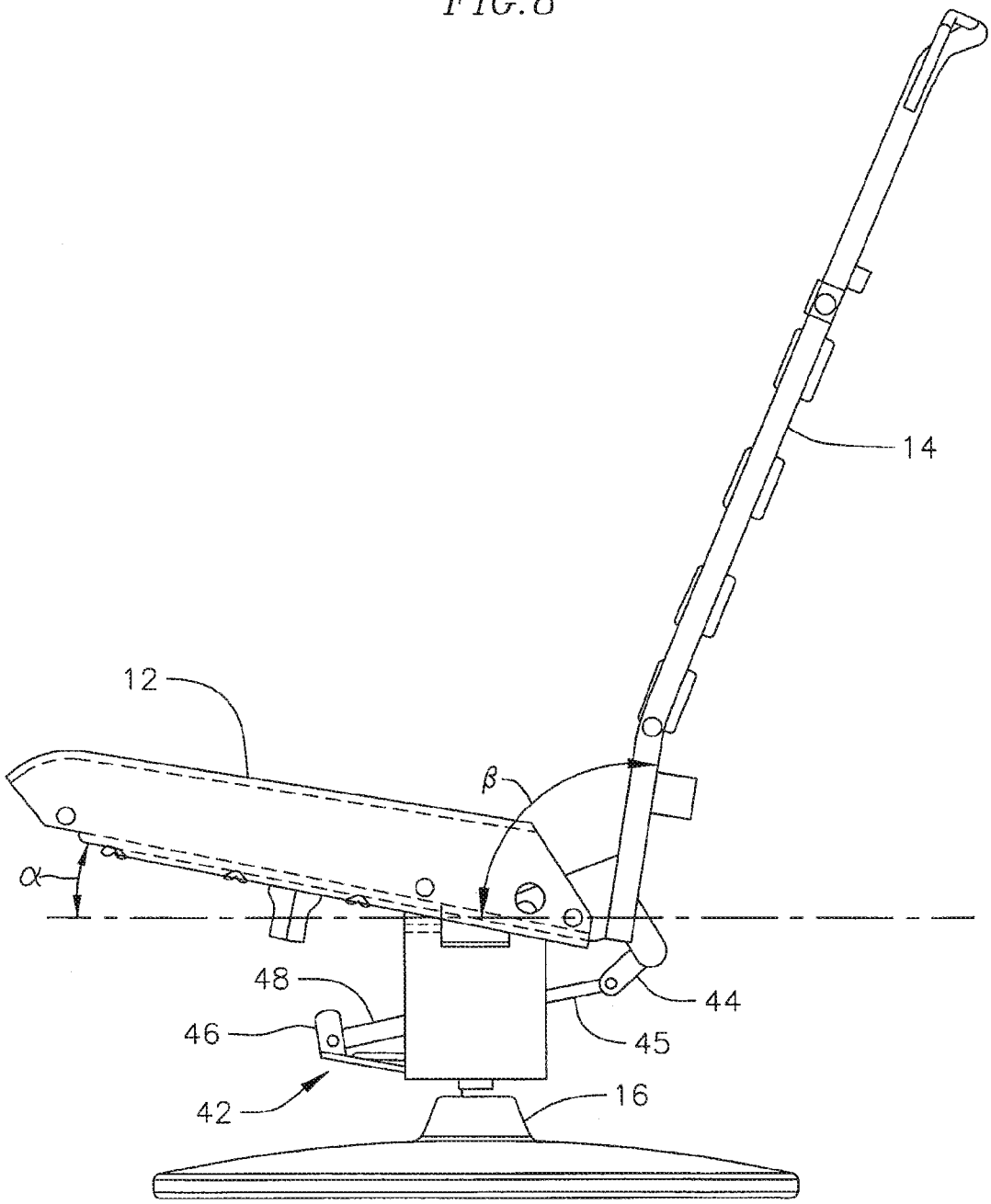
FIG. 8 is a side view of the articulating chair of FIG. 1 in the upright position, showing a biasing member in an extended position.
Figure 9:
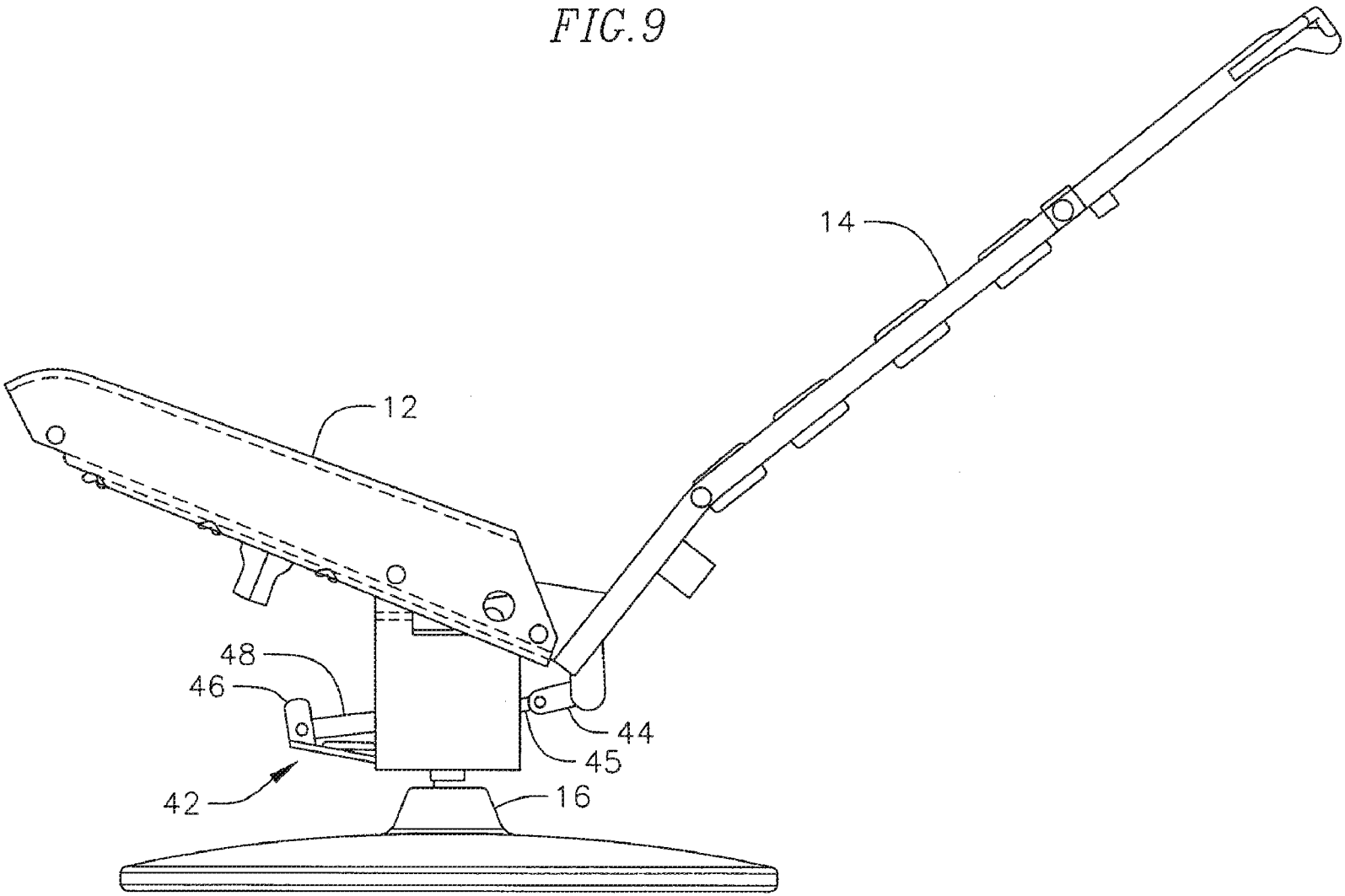
FIG. 9 is a side view of the articulating chair of FIG. 1 in the intermediate position, showing the biasing member in a retracted position.

The seat 12 is also pivotally connected to the mounting brackets 18 by pins 34, such as nut and bolt connections. As shown in FIGS. 5-7, each pin 34 rides within a slot 36 of a corresponding one of the mounting brackets 18. The slots 36 define the angular rotation of the seat 12 and the backrest 14 relative to the support frame 16.

FIG. 5 shows the articulating chair 10 in the upright position. In the upright position, the pins 34 are disposed at a first end 38 of the slots 36. As the articulating chair 10 rotates backwards from the upright position of FIG. 5 to the intermediate position of FIG. 6, the seat 12 rotates relative to the support frame 16 about pivots 32, while the backrest 14 rotates relative to the support frame 16 about pivots 30. At the intermediate position, the pins 34 start to slide from the first end 38 of the slots 36 towards a second end 40 of the slots 36.

As the articulating chair 10 rotates backwards from the intermediate position of FIG. 6 to the reclined position of FIG. 7, the seat 12 rotates relative to the support frame 16 about pivots 32 and the backrest 14 rotates relative to the support frame 16 about pivots 30, while the pins 34 slide along slots 36 from the first end 38 of the slots 36 to the second end 40 of the slots 36. As the pins 34 slide along slots 36, the backrest 14 pivots relative to the seat 12, causing the backrest 14 to rotate at a faster rate of rotation than the seat 12. This movement of the pins 34 also allows the backrest 14 to rotate over a larger angular range of rotation than that of the seat 12.

For example, in the depicted embodiment, when the articulating chair 10 is in the upright position, the seat 12 forms an angle $\alpha$ with a ground surface of approximately 15°, and the backrest 14 forms an angle $\beta$ with the ground surface of approximately 105° (see FIG. 1), while in the reclined position, the seat 12 forms an angle $\alpha'$ with the ground surface of approximately 40°, and the backrest 14 forms an angle $\beta'$ with the ground surface of approximately 155° (see FIG. 3). As such, in this embodiment, the seat 12 has an angular range of approximately 15° to approximately 40° and the backrest 14 has an angular range of approximately 105° to approximately 155°.

However, it is important to note that angles described above can be modified to meet any desired angular range for the seat 12 and any desired angular range for the backrest 14. These angular ranges can be modified for user comfort to meet desired positionings of the user's hip and back when the articulating chair 10 is in use.

For example, in alternative embodiments, when the articulating chair 10 is moved between the upright position and the reclined position, the seat 12 begins and ends anywhere in the angular range of approximately 0° to approximately 45°, and the backrest 14 begins and ends anywhere in the angular range of approximately 90° to approximately 180°. However, it is to be understood that these ranges are merely exemplary and can be modified as desired. For example, the angular range of rotation of the seat 12, the rate of rotation of the seat 12, the angular rotation of the backrest 14, the rate of rotation of the backrest 14, and/or the ratio of the angular range of rotation of the backrest 14 compared to the angular range of rotation of the seat 12, can be modified by changing the position of the backrest pivots 30, the position of the seat pivots 32, the geometry of the mounting bracket slots 36, and/or the length of the mounting bracket slots 36.

Figure 10:
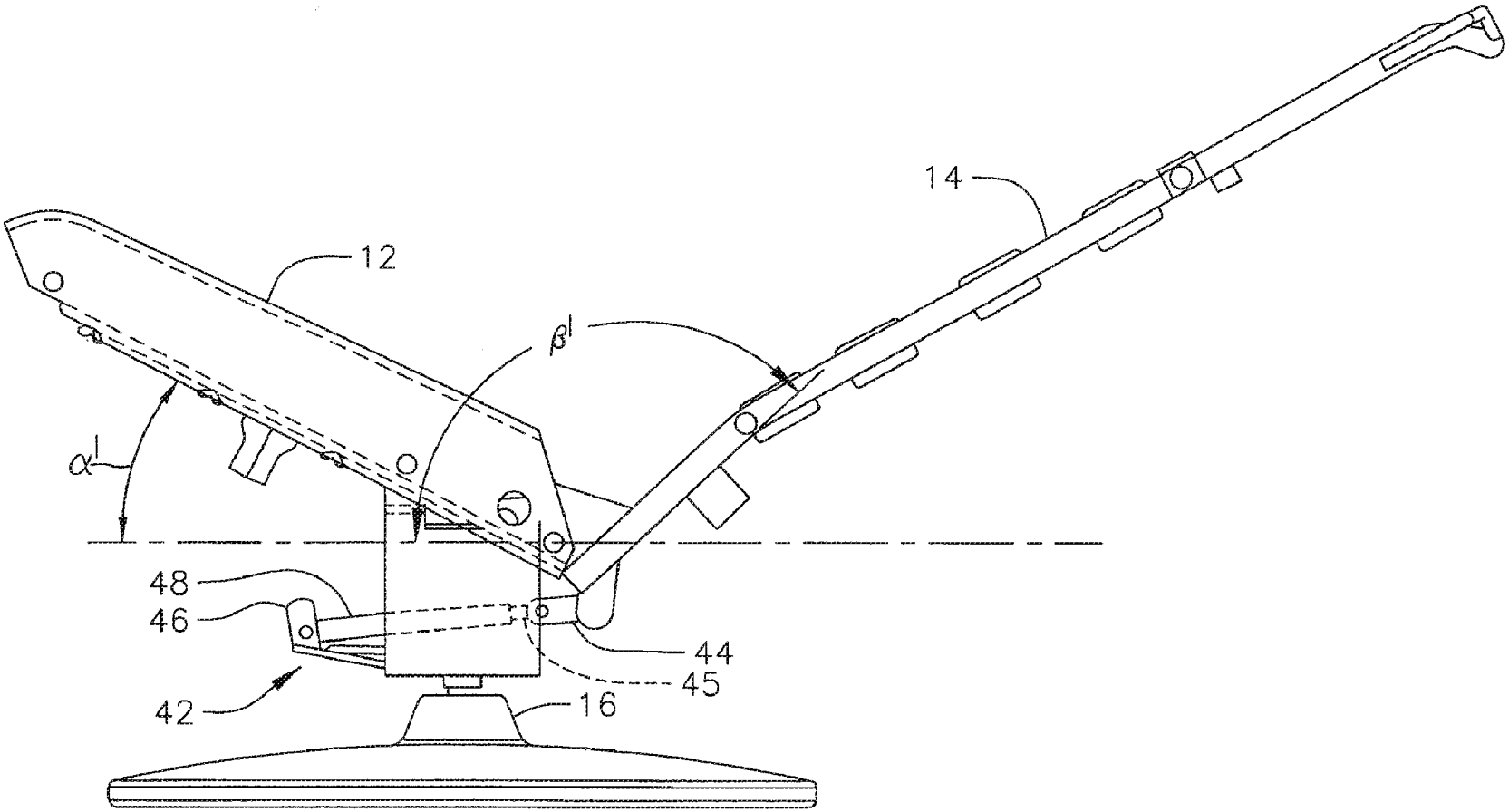
FIG. 10 is a side view of the articulating chair of FIG. 1 in the reclined position, showing the biasing member in a fully retracted position.

In one embodiment, the articulating chair 10 includes a biasing member 42 (see FIGS. 8-10) for biasing the articulating chair 10 towards the upright position. For example, in the depicted embodiment, the biasing member 42 is a gas spring. The gas spring includes a piston 45 and a gas cylinder 48. The piston 45 is moveable within the gas cylinder 48 between an extended position (FIG. 8) and a retracted position (FIG. 10.) The gas cylinder 48 contains a gas (not shown). When the piston 45 is moved from the expanded position towards the retracted position, the gas in the gas cylinder 48 is compressed and consequently applies a force against the piston 45 resisting the compression. As such, the piston 45 of the gas spring is continually biased toward the expanded position.

For clarity, the gas spring has been omitted from FIG. 4 to more clearly show the mounting flanges used to mount the gas spring to the articulating chair 10. As shown, a first mounting flange 44 is mounted to the connecting bar 22 of the support structure 22 of the backrest 14 and a second mounting flange 46 is mounted to the upper support 24 of the support frame 16. The piston 45 is mounted to the first mounting flange 44 of the backrest 14, and the gas cylinder 48 is mounted to the second mounting flange 46 of the support frame 16. Since the piston 45 is mounted to the backrest 14 and the piston 45 is biased towards the expanded position, the backrest 14 is biased toward the upright position. Since the seat is connected to the backrest 14, the seat 12 is also biased toward the upright position.

In one embodiment, the gas spring applies a constant force that provides little resistance to an average person who leans against the backrest 14 when moving the articulating chair 10 from the upright position to the reclined position, but provide a sufficient force to automatically return the articulating chair 10 to the upright position when the user's weight is removed from the backrest 14. As such, the force required from the gas spring is dependent on the weight of the chair and the force required to move the articulating chair 10, when unoccupied, from the reclined position to the upright position.

Although, the gas spring has been described as being connected between the support frame 16 and the backrest 14, in an alternative embodiment, the gas spring may be connected between the support frame 16 and the seat 12. In addition, although the biasing member 42 has been described as a gas spring, the biasing member 42 may be any suitable biasing member, such as a gas damper, a linear actuator, a power drive, a motor drive, or an electric screw drive, among other appropriate biasing members.

Figure 11:
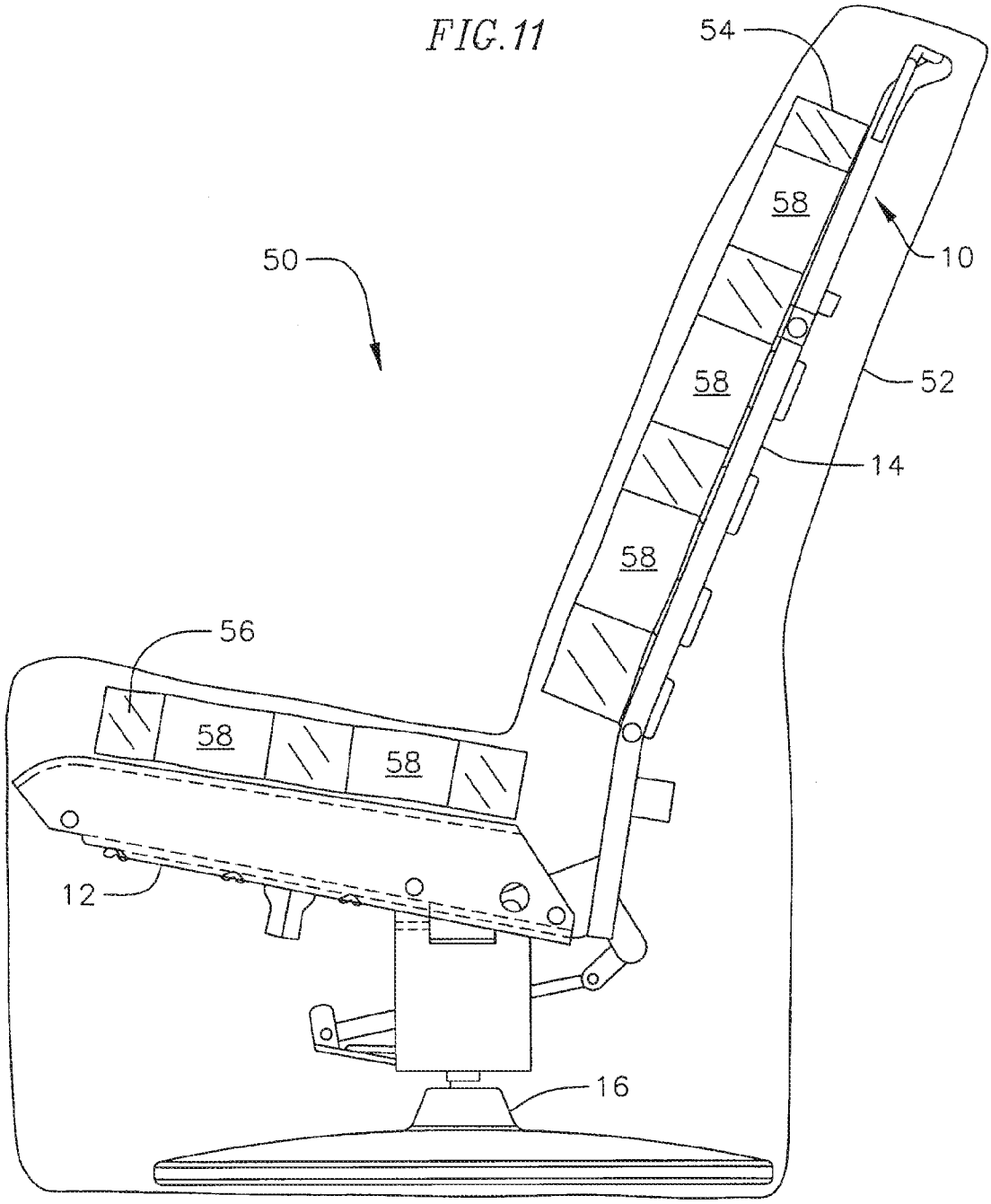
FIG. 11 is a schematic representation of the articulating chair of FIG. 1 used as a framework for a massaging chair.

In one embodiment, as shown in FIG. 11, the articulating chair 10 provides the framework for a massaging chair 50. The massaging chair 50 includes a cover 52 and padded sections 54 and 56 over the seat 12 and backrest 14 for user comfort. The massaging chair 50 also includes one or more massage devices 58 in the area of the backrest 14 and one or more massage devices 58 in the area of the seat 12. The massage devices 58 may be any one of a variety of massage devices known in the art.

The preceding description has been presented with references to presently preferred embodiments of the invention. Persons skilled in the art and technology to which this invention pertains will appreciate that alterations and changes in the described structures and methods of operation can be practiced without meaningfully departing from the principle, spirit and scope of this invention. Accordingly, the foregoing description should not be read as pertaining only to the precise structures described and shown in the accompanying drawings.

What is claimed is:

1. An articulating massaging chair comprising:

a support frame;

a seat pivotally connected to the support frame by a seat pivot;

a backrest pivotally connected to the support frame by a backrest pivot; and a backrest mounting bracket that pivotally connects the seat to the backrest;

wherein the seat is pivotally connected to the backrest at a location below the seat pivot, wherein the backrest and the seat rotate in the same angular direction, and wherein an angular range of rotation of the backrest is greater than an angular range of rotation of the seat.

2. The articulating massaging chair of claim 1, wherein the backrest mounting bracket comprises a slot that receives a pin, and wherein the pin is slidable along the slot.

3. The articulating massaging chair of claim 1, wherein the backrest mounting bracket is configured to rotate a front edge of the seat up when the backrest reclines.

4. The articulating massaging chair of claim 1, wherein the mounting bracket comprises a slot that receives a pin, and wherein the pin pivotally connects the seat to the backrest.

5. The articulating massaging chair of claim 4, wherein the mounting bracket defines an angular range of rotation of the backrest and an angular range of rotation of the seat.

6. The articulating massaging chair of claim 4, wherein the pin rests in an upper end of the slot when the backrest is in an upright position, and the pin rests in a lower end of the slot when the backrest is in a reclined position.

7. The articulating massage chair of claim 4, wherein the slot is angled with respect to horizontal.

8. The articulating massaging chair of claim 1, further comprising a biasing member, wherein the backrest is moveable between an upright position and a reclined position and wherein the biasing member biases the backrest toward the upright position.

9. The articulating massaging chair of claim 8, wherein the biasing member is connected between the support frame and the backrest.

10. The articulating massaging chair of claim 9, wherein the biasing member is a gas spring.

11. The articulating massaging chair of claim 8, wherein the biasing member is a chosen from the group consisting of a gas damper, a linear actuator, a power drive, a motor drive, and an electric screw drive.

12. The articulating massaging chair of claim 1, wherein the backrest comprises at least one massaging device.

13. The articulating massaging chair of claim 1, wherein the seat comprises at least one massaging device.

14. An articulating massaging chair movable between an upright position and a reclined position and comprising:

a support frame;

a seat pivotally connected to the support frame by a seat pivot;

a backrest pivotally connected to the support frame by a backrest pivot;

a mounting bracket connecting to the backrest and having a slot that receives a pin, wherein the pin pivotally connects the seat to the backrest, and wherein the seat is pivotally connected to the backrest at a location below the seat pivot; and at least one massaging device connected to at least one of the seat and the backrest.

15. The articulating massaging chair of claim 14, wherein the mounting bracket slot defines an angular range of rotation of the backrest and an angular range of rotation of the seat.

16. The articulating massaging chair of claim 14, wherein the backrest pivots relative to the support frame about the backrest pivot, the seat pivots relative to the support frame about the seat pivot, and the backrest pivots relative to the seat about the pin, and wherein the pin slides along the slot of the mounting bracket causing the backrest to pivot relative to the seat, such that an angular range of rotation of the backrest is greater than an angular range of rotation of the seat.

17. The articulating massaging chair of claim 14, wherein the slot is located below the seat pivot.

18. The articulating massaging chair of claim 14, further comprising a biasing member, wherein the backrest is moveable between an upright position and a reclined position and wherein the biasing member biases the backrest toward the upright position.

19. The articulating massaging chair of claim 18, wherein the biasing member is connected between the support frame and the backrest.

20. The articulating massaging chair of claim 19, wherein the biasing member is a gas spring.

21. The articulating massaging chair of claim 18, wherein the biasing member is a chosen from the group consisting of a gas damper, a linear actuator, a power drive, a motor drive, and an electric screw drive.

22. The articulating massaging chair of claim 14, wherein the at least one massaging device comprises a first massaging device supported by the backrest and a second massaging device supported by the seat.

23. An articulating massaging chair comprising:

a support frame;

a seat pivotally connected to the support frame by a seat pivot;

a backrest pivotally connected to the support frame by a backrest pivot; and a backrest mounting bracket that pivotally connects the seat to the backrest;

wherein the backrest and the seat rotate in the same angular direction, wherein an angular range of rotation of the backrest is greater than an angular range of rotation of the seat, and wherein the angular range of rotation of the seat is approximately 25° and the angular range of rotation of the backrest is approximately 50°.

24. The articulating massaging chair of claim 23, wherein the seat is pivotally connected to the backrest at a location below the seat pivot.

25. The articulating massaging chair of claim 23, wherein the backrest mounting bracket comprises a slot that receives a pin that pivotally connects the backrest to the seat, and wherein the pin is slidable along the slot.

26. The articulating massaging chair of claim 25, wherein the pin rests in an upper end of the slot when the backrest is in an upright position, and the pin rests in a lower end of the slot when the backrest is in a reclined position.

27. The articulating massage chair of claim 26, wherein the slot is angled with respect to horizontal.

28. The articulating massaging chair of claim 23, wherein the backrest mounting bracket is configured to rotate a front edge of the seat up when the backrest reclines.

29. The articulating massaging chair of claim 23, further comprising a biasing member, wherein the backrest is movable between an upright position and a reclined position and wherein the biasing member biases the backrest toward the upright position.

* * * * *